US005577971A

United States Patent [19]

File

[11] Patent Number: 5,577,971

[45] Date of Patent: Nov. 26, 1996

[54] METHOD OF PLAYING A COMBINATION GAME OF BOWLING AND RANDOM NUMBER MATCHING

[76] Inventor: Jonathan P. File, 210 S. Washington Ave., Louisville, Colo. 80027

[21] Appl. No.: 477,196

[22] Filed: Jun. 7, 1995

Related U.S. Application Data

[63] Continuation-in-part of Ser. No. 922,721, Jul. 31, 1992, Pat. No. 5,449,326, which is a continuation-in-part of Ser. No. 242,309, May 13, 1994.

[51] Int. Cl.[6] ..... A63D 3/00

[52] U.S. Cl. ..... 473/54; 273/269

[58] Field of Search ..... 473/54, 70, 113; 273/269

[56] References Cited

U.S. PATENT DOCUMENTS

| | | | |
|---|---|---|---|
| 463,454 | 11/1891 | Rogers . | |
| 1,124,365 | 1/1915 | Virgien, Sr. . | |
| 2,329,963 | 9/1943 | Whittle | 273/37 |
| 2,610,055 | 11/1952 | Goodyear | 273/39 |
| 3,009,268 | 11/1961 | George, Sr. | 35/29 |
| 3,401,933 | 9/1968 | Conklin et al. | 273/37 |
| 3,907,290 | 9/1975 | Fischer et al. | 273/54 |
| 4,131,948 | 12/1978 | Kaenel | 364/900 |
| 4,225,924 | 9/1980 | Trujillo . | |
| 4,323,240 | 4/1982 | Stewart et al. | 273/269 |
| 4,330,122 | 5/1982 | Sheinberg et al. | 273/51 |
| 4,501,426 | 2/1985 | Seitz | 273/277 |
| 4,689,742 | 8/1987 | Troy et al. | 364/412 |
| 4,754,967 | 7/1988 | Edler et al. | 273/43 |
| 4,834,378 | 5/1989 | Brim | 273/37 |
| 4,834,381 | 5/1989 | Brim | 273/37 |
| 4,887,813 | 12/1989 | Chiles, III et al. | 273/54 |
| 4,900,024 | 2/1990 | Chandler et al. | 273/37 |
| 4,937,772 | 6/1990 | Chavez et al. | 364/715.01 |
| 5,188,105 | 6/1992 | Brim et al. | 273/54 |
| 5,198,976 | 3/1993 | Form et al. | 364/410 |
| 5,255,185 | 10/1993 | Mowers et al. | 364/411 |
| 5,342,059 | 8/1994 | Briem et al. | 273/277 |
| 5,344,199 | 9/1994 | Carstens et al. | 273/138 |
| 5,359,510 | 10/1994 | Sabaliauskas | 364/410 |
| 5,437,575 | 8/1995 | Douglass | 473/54 |

FOREIGN PATENT DOCUMENTS

| | | |
|---|---|---|
| 1174666 | 7/1964 | Germany . |
| 2043857 | 3/1972 | Germany . |
| 2403151 | 8/1974 | Germany . |
| 471587 | 4/1969 | Switzerland . |

*Primary Examiner*—William M. Pierce
*Attorney, Agent, or Firm*—Gunn, Lee & Miller, P.C.

[57] ABSTRACT

A game method of play combining the skill elements of bowling with the chance elements of bingo and lottery. The game method of play includes the steps of randomly arranging and displaying a set of numbers in an order in which the numbers are to be picked for the purposes of separately identifying a lottery-type arrangement or a bingo-type arrangement. The game play further involves a number of bowlers participating in a sequence of bowling flames such that the scores in the bowling flames are compared with the randomly arranged numbers previously displayed. As the randomly arranged numbers are sequentially stepped through in the comparison process, orderly patterns of matched scores and numbers are detected and identified as winning arrangements when acquired. Various sets of specific numbers, such as in a lottery game, or various orderly patterns such as those typically found in bingo, may be utilized to identify the winner of a particular game.

5 Claims, 5 Drawing Sheets

Fig. 4A 48 44 42

| | | | | | | | |
|---|---|---|---|---|---|---|---|
| 1 | 21 | 26 | 33 | 51 | 80 | 76 | 50 |
| 2 | 90 | 27 | 12 | 52 | 20 | 77 | 27 |
| 3 | 64 | 28 | 43 | 53 | 89 | 78 | 42 |
| 4 | 7 | 29 | 16 | 54 | 49 | 79 | 60 |
| 5 | 57 | 30 | 41 | 55 | 1 | 80 | 10 |
| 6 | 51 | 31 | 81 | 56 | 61 | 81 | 39 |
| 7 | 13 | 32 | 88 | 57 | 28 | 82 | 3 |
| 8 | 31 | 33 | 4 | 58 | 75 | 83 | 32 |
| 9 | 71 | 34 | 38 | 59 | 40 | 84 | 19 |
| 10 | 2 | 35 | 97 | 60 | 5 | 85 | 74 |
| 11 | 48 | 36 | 26 | 61 | 15 | 86 | 22 |
| 12 | 9 | 37 | 70 | 62 | 87 | 87 | 59 |
| 13 | 44 | 38 | 94 | 63 | 56 | 88 | 8 |
| 14 | 76 | 39 | 47 | 64 | 82 | 89 | 63 |
| 15 | 23 | 40 | 95 | 65 | 25 | 90 | 14 |
| 16 | 98 | 41 | 62 | 66 | 69 | 91 | 52 |
| 17 | 58 | 42 | 30 (46) | 67 | 53 | 92 | 37 |
| 18 | 18 | 43 | 77 | 68 | 91 | 93 | 73 |
| 19 | 84 | 44 | 45 | 69 | 86 | 94 | 29 |
| 20 | 36 | 45 | 99 | 70 | 6 | 95 | 83 |
| 21 | 93 | 46 | 85 | 71 | 67 | 96 | 46 |
| 22 | 66 | 47 | 35 | 72 | 72 | 97 | 24 |
| 23 | 100 | 48 | 92 | 73 | 55 | 98 | 17 |
| 24 | 79 | 49 | 11 | 74 | 78 | 99 | 96 |
| 25 | 54 | 50 | 68 | 75 | 65 | 100 | 34 |

Fig. 2

40

METHOD OF PLAYING A COMBINATION GAME OF BOWLING AND RANDOM NUMBER MATCHING

BACKGROUND OF THE INVENTION

This application is a continuation in part of application Ser. No. 07/922,721, now U.S. Pat. No. 5,449,326, which is a continuation in part of application 08/242,309, pending.

1. Field of the Invention

The present invention relates generally to methods of game play associated with bowling pins, bowling balls, and bowling lanes. The present invention relates more specifically to a game play method that combines some of the game play steps normally associated with the basic game of bowling with the generation and selection of random numbers in a manner normally associated with the games of bingo and lottery.

2. Description of the Related Art

The standard rules of bowling have remained fairly consistent over time and have turned the game into what is predominantly one of skill versus a game of chance. Although the inexperienced bowler may on occasion enjoy a spare or a strike, the highest scores in the game are generally only achieved by those who have obtained a high level of skill. While this fact does not altogether discourage the inexperienced bowler from participating in the sport, it does confine the inexperienced bowler to competing against those that are at the same skill level.

The basic rules of bowling consist of bowlers engaging in what are essentially two-ball frames for a sequence of ten frames to arrive at a final score that is compared with other bowlers who bowl at the same time. In most cases, the bowlers who are competing against each other are in adjacent bowling lanes in the same bowling alley. A perfect score, according to the standard rules of bowling, is 300 and involves a strike on each of twelve tries with the bowling ball.

Each frame is nominally associated with the rolling of a first and then a second ball by each bowler. If the first ball is a strike, no second ball is thrown. A bowler may, therefore, throw as many as twenty-one balls during a complete game, or as few as twelve. In any event, scoring is accomplished by adding the number of pins knocked down in each frame to the total previously acquired in earlier frames. Spares involve a total of ten plus the sum of the next ball thrown, and strikes involve a total of ten plus the sum of the next two balls thrown. In every case, the goal is to knock down as many pins as possible with each ball thrown. The skills, therefore, involve appropriate targeting and placement of the ball when thrown such that the maximum number of pins will be knocked down.

Some modifications of the apparatus associated with the play of a standard game of bowling have been implemented and have allowed the less experienced bowler to compete more directly with those whose skill level is higher. Applicant's co-pending applications Ser. Nos. 07/922,721 and 08/242,309 describe and disclose a bowling system and method that incorporates bumpers in a manner that may alter the scoring procedure during a game of bowling. These bumper bowling systems and methods permit inexperienced players to acquire new skills at the same, or at an advanced rate, over those already skilled at the standard rules of bowling. Some aspects of applicant's bumper bowling systems also permit random factors to enter into the final score in any frame and thus, in any particular game of bowling.

Despite this, it would be desirable to incorporate additional elements of randomness and chance into the play of bowling such that unskilled players might compete more directly against those skilled in the game.

Two games commonly associated with randomness and chance, as opposed to skill are the games of bingo and of lottery. Lottery games generally involve the random selection of some set of numbers that may or may not be matched by those who participate in the game. The typical lottery game might involve a set of six numbers, each number having a value from 1–50, with no two of the numbers being the same. Participants in the lottery game guess and select six such numbers prior to some random number generating device selecting the six numbers. Many state lotteries are based upon a system such as this.

Bingo is in many respects a more complex type of lottery game in that participants utilize a card with a random arrangement of numbers selected from the number group 1–100, organized in a two-dimensional matrix, typically 5 by 5. Individual numbers are then randomly selected and identified on each player's card matrix. The first player to acquire a specific pattern of matched numbers on his or her card is declared the winner.

Heretofore, no effort has been made to combine the skill characteristics of the game of bowling with the chance characteristics of either a lottery game or the game of bingo. It would be desirable to incorporate some of the random aspects of the games of lottery and bingo into the game of bowling in a manner that would permit unskilled bowlers to compete against those more skilled in the field, either according to rules associated with the standard game of bowling, or rules associated with a bumper bowling system such as that described in applicant's co-pending applications referenced above.

SUMMARY OF THE INVENTION

It is therefore an object of the present invention to provide a game method of play that combines some of the skill elements associated with the standard game of bowling with some of the chance and randomness elements associated with the games of lottery and bingo.

It is a further object of the present invention to provide a game method of play that permits the use of chance elements such as those found in bingo and lottery in conjunction with the play of a bowling game according to the standard rules of bowling.

It is a further object of the present invention to provide a game method of play that permits the use of chance elements such as those found in bingo and lottery in conjunction with the play of a bowling game according to the modified rules of bumper bowling game play that involve the intentional direction of a bowling ball against a bumper to achieve a specific score distinct from that normally achieved in standard rules of bowling.

It is a further object of the present invention to combine both skill and chance elements into a single game play format that permits unskilled bowlers to compete directly against skilled bowlers in a manner that increases the likelihood that an unskilled bowler might prevail in the competition.

It is a further objection of the present invention to provide a combination of chance elements and skill elements in a game of bowling in a manner that permits bowlers to compete against other bowlers in the same bowling alley, at the same time, or to compete against bowlers in distinct bowling alleys at distinct times.

In fulfillment of these and other objectives, the present invention provides a game method of play that progresses through a sequence of bowling flames, bowled by a number of bowlers at the same or different times, and involves a selected group of random numbers arranged in an array such as that typically found in the game of bingo, wherein the scores achieved by each bowler in each frame are compared with the randomly generated array such that when a bowler or group of bowlers acquires a set of scores, either in a sequence of flames or through a sequence of bowlers in a single frame, that matches a set of random numbers in the randomly generated array, that bowler or that set of bowlers is declared winner.

The randomly generated array of numbers may have a single dimension such as one set of six numbers, so as to imitate a lottery system, or may be two dimensional such as five sets of five numbers, as is typical in a bingo card arrangement. Variations between the examples mentioned above and beyond such examples even to the point of three-dimensional arrays are considered plausible by the present invention.

The present invention, generally speaking, provides a goal to be achieved according to standard or modified rules of bowling wherein the highest pin count does not necessarily win the game. The present invention provides a set of rules whereby specific pin counts, not necessarily the highest pin counts, are strived for in order to acquire a set of numbers randomly arranged and displayed for the bowlers to strive for.

BRIEF DESCRIPTION OF THE DRAWING

FIG. 2 discloses a sample random number sheet that includes a typical set of random numbers generated for the purpose of identifying winning patterns on the score sheet disclosed in FIG. 1.

DESCRIPTION OF THE PREFERRED EMBODIMENT

Figure 1:
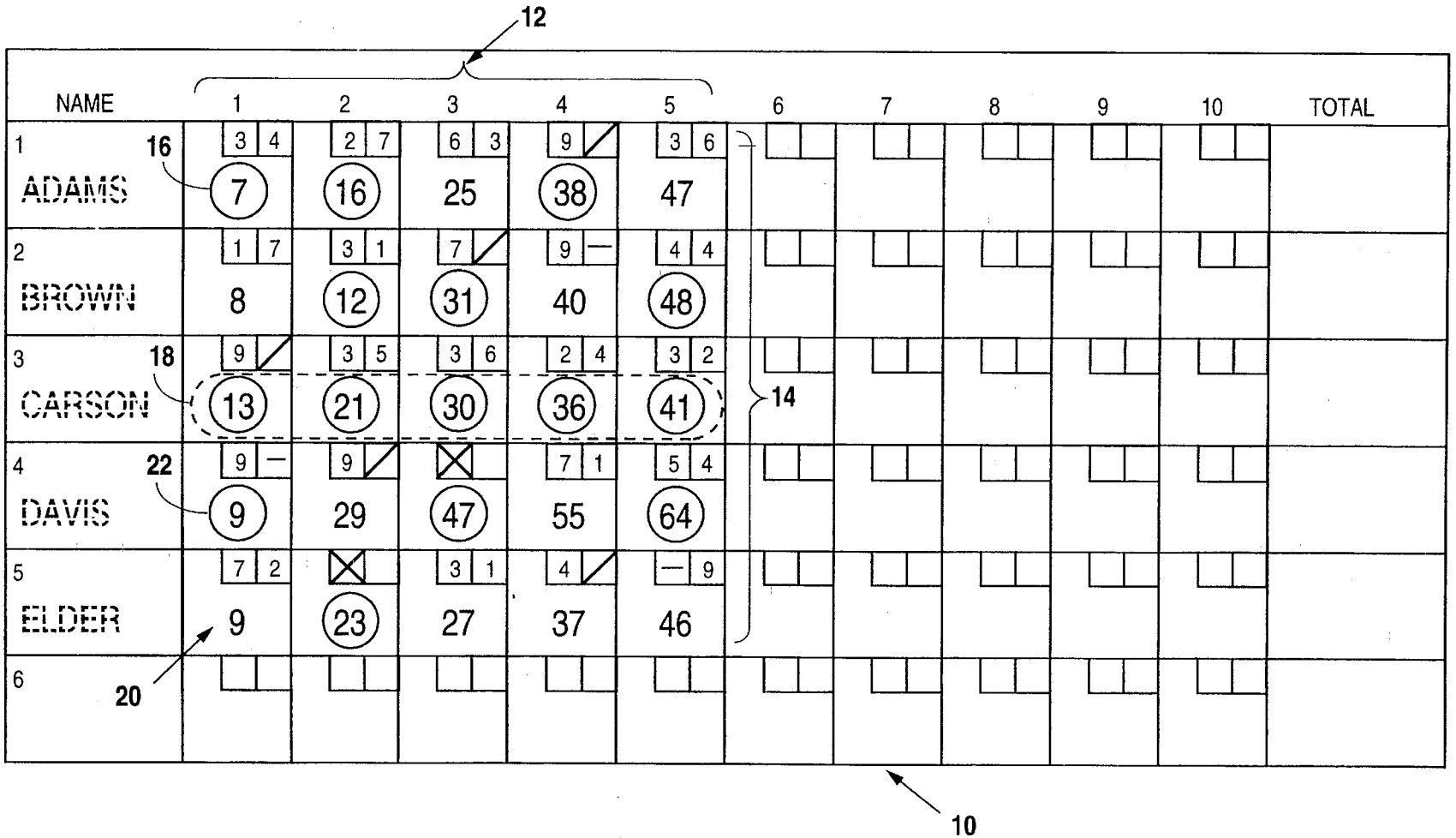
FIG. 1 discloses a sample score sheet that incorporates a typical set of scores associated with the play of the game method of the present invention.
Figure 3:
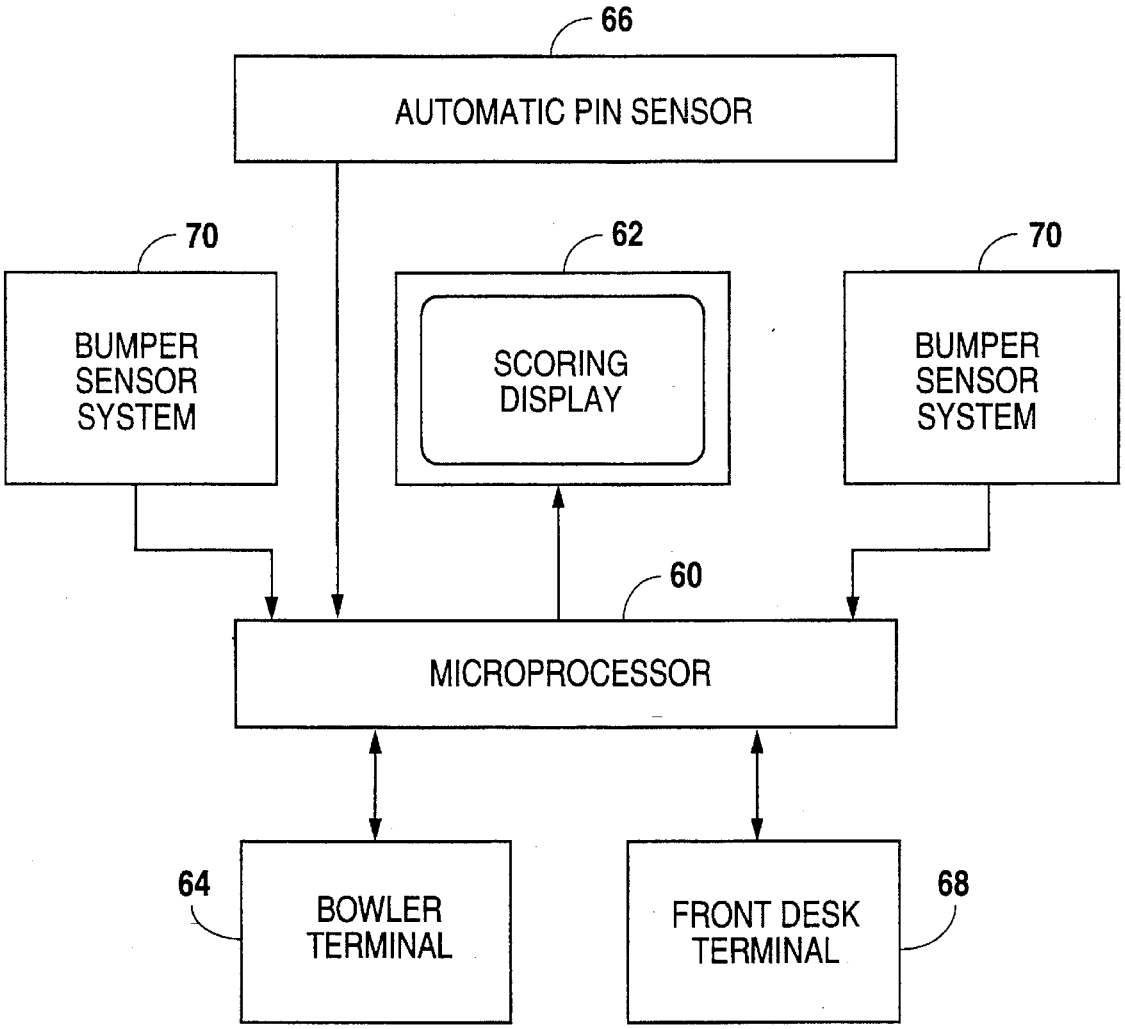
FIG. 3 discloses a schematic block diagram of system appropriate for implementation of the game method of the present invention.

1. Brief Description of Method of Game Play

The game play method of the present invention can be briefly described as follows. Initially, numbers from 1–100 are randomly arranged and provided to all of the players before bowling actually begins. In this way, the order in which the numbers will come up is known ahead of time by each of the players. An object at this point in the play of the game is to look at the order of numbers and try to achieve scores that match the numbers closest to the beginning of the list (i.e., the first numbers that will be "called" in the bingo stage of the game).

Bowling is then begun with scores being posted and displayed in ordinary fashion. In the preferred embodiment of the present invention, five bowlers will bowl five flames each to completion. This will create an array of scores 5 by 5 in size. This is the same size as the typical array of numbers found on a bingo card.

As soon as five frames of five bowlers are complete, the randomly arranged numbers are compared against each frame's score for each of the five bowlers. Whenever a randomly arranged number matches a score in a particular frame, an indication is made on that frame. The random numbers are each sequentially compared with the frame scores until a specific pattern of matching indications is created on some team's score card. This usually occurs when a "bingo" or a row of indications results from a series of matched scores.

2. Detailed Description of the Method of Play of the Present Invention

In general, as described above, it can be seen that the game method of the present invention is a combination of the chance ordering of numbers from 1–100 and the skill associated with being able to bowl a specific number of pins in a particular frame. The present invention is, therefore, a blend of both chance elements and skill elements into a single game format.

The play of the game of the present invention lends itself to scoring by automatic means such as that provided by a computer. Since most bowling alleys incorporate computerized scoring systems, the implementation of the game play of the present invention is quite straightforward.

Initially, an array, A(100), is created and is stored with a randomly ordered set of numbers from 1–100. Each number element in array A is different from every other number element and every number from 1–100 is represented. This randomly ordered array is then printed or displayed so that every bowler is aware of the order in which the numbers will be "called" in the bingo portion of the game play. This allows bowlers to control, to some extent, their ability to "mark" their score card to facilitate the acquisition of a bingo.

With the order of the numbers displayed, bowlers proceed to bowl at least five frames. In general, a five game group of five frames is necessary in the preferred embodiment to establish a "bingo card" suitable for play. The five game, five frame structure may involve five separate bowlers or may involve fewer, with one or more bowlers repeating or playing twice. In this manner, a five game-by-five frame bingo card is created.

FIG. 1 discloses a typical score sheet and set of scores for one group of bowlers, or team, in the game. FIG. 2 discloses the array of randomly ordered numbers from which the bowlers may anticipate the "bingo numbers" being derived. FIG. 2 discloses a typical method of arranging, in an easily discernable fashion, the numbers 1–100 in random order. Table (40) in FIG. 2, is comprised of 100 numerical cells (42), each bearing a randomly ordered number (46) and a sequential identifying cell number (48) that indicates the order in which the randomly ordered numbers will be called. Bowlers would anticipate that at least the first five numbers (in this case 21, 90, 64, 7, and 57) will be called, and in all likelihood, as many as 40–50 numbers will be called.

Referring back to FIG. 1, and in combination with table (40) shown in FIG. 2, a complete scoring of a typical game of the present invention can be described. FIG. 1 shows a standard bowling score sheet utilized in this case with the rules of play for the game method of the present invention.

Whereas the typical bowling game might incorporate ten flames, the preferred game method of play of the present invention would utilize only five. Score card (10) in FIG. 1 shows the scores contained in five frame columns (12) for five bowler rows (14). Bowling among the five bowlers, Adams, Brown, Carson, Davis and Elder, proceeds as would normally occur in a standard game of bowling, with each bowler paying attention to the randomly ordered set of numbers in Table (40) shown in FIG. 2. Typically, table (40) would either be displayed on a video monitor such that all bowlers could refer to it during the game, or would be printed on a form available to each bowler during the game.

In any event, the five bowlers would continue to accumulate scores through five flames as indicated in FIG. 1. Once five flames for five bowlers have been completed, a comparison is made between the randomly ordered numbers in table (40) of FIG. 2 with the scores achieved and recorded on score card (10) in FIG. 1. An indication means is used to show those scores that match numbers in table (40) as they are sequentially compared. In other words, as the example in FIGS. 1 and 2 shows, the first number randomly ordered in table (40) is the number 21. On score card (10), the score for Carson in frame 2 is 21. Thus, this score is circled as an indication that it matches a score in table (40).

It is necessary that the numbers disclosed in table (40) be taken and compared with the scores on score card (10) one at a time in the order in which they have been arranged. It can be clearly seen that every score entered on score card (10) will be found at some point in table (40) so the order in which the numbers are arranged in table (40) is determinative of how early in the process a particular score on score card (10) is circled or indicated as matching.

The numbers in table (40) continue to be stepped through and compared with the scores on score card (10). It is anticipated that a number of score cards (10) would be compared with the numbers in table (40) at the same time. They may, for example, be as many as 20–25 teams bowling at a time and creating score cards (10) similar to that shown in FIG. 1. Indications of matching scores in FIG. 1 are shown on the assumption that this particular score card would be the first to create a bingo-type pattern among the scores. In this case, indications (16) on score card (10) are implemented progressively until a bingo pattern is established. In this case, bingo pattern (18) is established when each of the frame scores for bowler Carson are circled. It is noted that this bingo pattern was achieved only after number elements (42) in table (40) up to the number element containing the number 30 are stepped through. Once a bingo arrangement is identified on any one of the score cards (10) being compared with table (40), the process is stopped and a winner is declared.

It is noted that in many cases, two frames on an individual score card (10) might contain the same numerical score. This is shown in FIG. 1 at flames (20) and (22), which both include the numerical score 9. Variations of the rules of the game of the present invention could permit both such scores to be circled and utilized to create a bingo pattern or may permit only a first of such scores to be utilized. In the preferred embodiment shown in the present case, only the first of such scores is utilized, thus preventing a bingo pattern from occurring that utilizes the first frame of bowler Elders' game. A reason for incorporating this limitation would be to prevent the not unlikely event that all five bowlers on a particular team might score the same score in the first frame intentionally, so as to possibly acquire a bingo pattern with only one or two numbers called from table (40).

A similar concern is raised when it becomes evident that an individual bowler could attempt to duplicate a score in as many as five consecutive frames by continuously throwing gutter balls. If, for example, the number 8 appeared as one of the early numbers in table (40), a bowler participant may score an 8 in the first frame and thereafter decide to retain that score in each subsequent frame through the fifth frame. If each of these frame scores counted, that bowler would automatically acquire a bingo with little effort on his part. In order to prevent this, the preferred embodiment of the present invention incorporates a rule wherein a gutter ball on the first ball of a frame must be given some non-zero score. This non-zero score could simply have a value of 1 or might be a randomly generated score from 1–10. In any event, such a rule is necessary to prevent the inappropriate result described above.

Once again, it is important to note that table (40) in FIG. 2 is displayed so that bowlers might review it prior to beginning the game and attempt to acquire some of the "earlier" selected numbers in the table.

As an example, referring again to FIG. 2, bowlers might look at the first ten numbers listed in the display as an indication of what numbers they might best be shooting for. In FIG. 2, the first five numbers are 21, 90, 64, 7, and 57, respectively. Bowlers could likely assume that the number 90 will be difficult to obtain in five frames and may dismiss it as unimportant. Likewise, in the earlier flames, bowlers would recognize that the numbers 64 and 57 will be unattainable until the fourth or fifth frame. Of the first few numbers, therefore, 7 and 21 may provide the best goals for bowlers to shoot for in the early flames.

In FIG. 1, it can be seen that bowler Adams, was able to bowl a 3 and a 4 for a total score of 7 in frame 1. The result could have been due to Adams skill in rolling a 7, or could have simply been by chance contact and scoring of pins.

A better example may be Davis in frame 1. Davis might note that the twelfth randomly ordered number is the number 9, and having bowled a 9 on the first ball of the first frame, may choose to intentionally gutter the second ball to retain 9 as a score. Carson in frame 1, having made a spare, might have tried to bowl a 3 on the first ball of frame 2, specifically to obtain the number 13 in the first frame, which came up seventh in the order of random numbers shown in FIG. 2.

In this way, bowlers can benefit both from their own skill and ability to generate specific scores on a flame-by-frame basis, and benefit from the randomness associated with the order in which these scores come up.

In its preferred form, the method of play of the present invention would involve the random ordering of numbers from 1–100 as indicated above, and the bowling of five frames in five games. Even without an automatic scoring system, bowlers could circle, or otherwise indicate that a particular number as it comes up in the orderly random arrangement shown, matches a number on the scoring sheet. When a preselected set of indications exists on a scoring sheet, a bingo is declared. The example shown in FIG. 1, five scores are matched for bowler Carson, in each of the five frames bowled. Five in a row, across, down, left-to-right diagonally, right-to-left diagonally, might also be "bingos" in this basic play. Likewise, a "home-run" bingo might be declared when a circle of scores are matched, or a complete "wipe out", wherein all scores are matched. Finally, a "strike", which is a combination of two diagonals, might also be defined as accomplishing a bingo.

A method for determining the existence of a bingo as the game proceeds could be accomplished through the use of the computer-based scoring system. In such a case, it is preferable to create three arrays that the computer constantly updates and compares. Array "A" is a one-dimensional array with 100 elements that will contain the randomly ordered set of numbers 1–100. Array "B" is a two-dimensional array 5 by 5 in size, and will incorporate the scores as they accumulate by the five players through five frames. Array "C" is also a 5 by 5 array with each element having a value of 0 or 1, depending upon whether a match indicator has been placed on that particular element.

As bowling progresses, array "B" is filled with the scores from each player, each frame. After five players and games of five flames are completed, array "A" is compared with array "B", one element at a time, stepping through array "A" in order. Thus, element A(1) is compared with element B(1, 1). If they are equal, element C(1, 1) in array "C" is set equal to 1. Every element in array "B" is checked against element A(1) and the corresponding element in array "C" is set if they are equal. The next element in array "A" is then compared with every element in array "B" and appropriate elements in array "C" are set as before.

As each element in array "A" is compared to elements in array "B", a check of array "C " is made to determine if any bingos exist. In this manner, the very first bingo will be identified and array "A" will be stepped through only to the point at which a bingo occurs.

Various configurations for array "C" would exhibit a bingo. For example, if elements C(x, 1-5), x equal to any number, are all equal to 1, then á bingo across exists. If elements C(1-5,y), y equal to any number, are all equal to 1, then a bingo down exists. If array elements C(n,n), n equal to any number, are all equal to 1, then a left-to-right diagonal bingo exists. If array elements C(n,6-n), n equal to any number, all equal to 1, then a right-to-left diagonal bingo exists.

A "home-run" bingo exists if elements C(1,1-5) are all equal to 1, C(5,1-5) all equal to 1, C(2-4,1) all equal to 1, and C(2-4,5) all equal to 1.

A "wipe-out" bingo exists if elements C(1-5,1-5) all equal to 1. A "strike" bingo exists if elements C(n,n) are all equal to 1 and elements C(n,6-n) are all equal to 1.

In any event, the computer scoring system checks each of the possible bingo combinations in array "C " prior to progressing to the next randomly ordered number in array "A". In this manner, the first bingo among all those playing is identified.

Figure 4A:
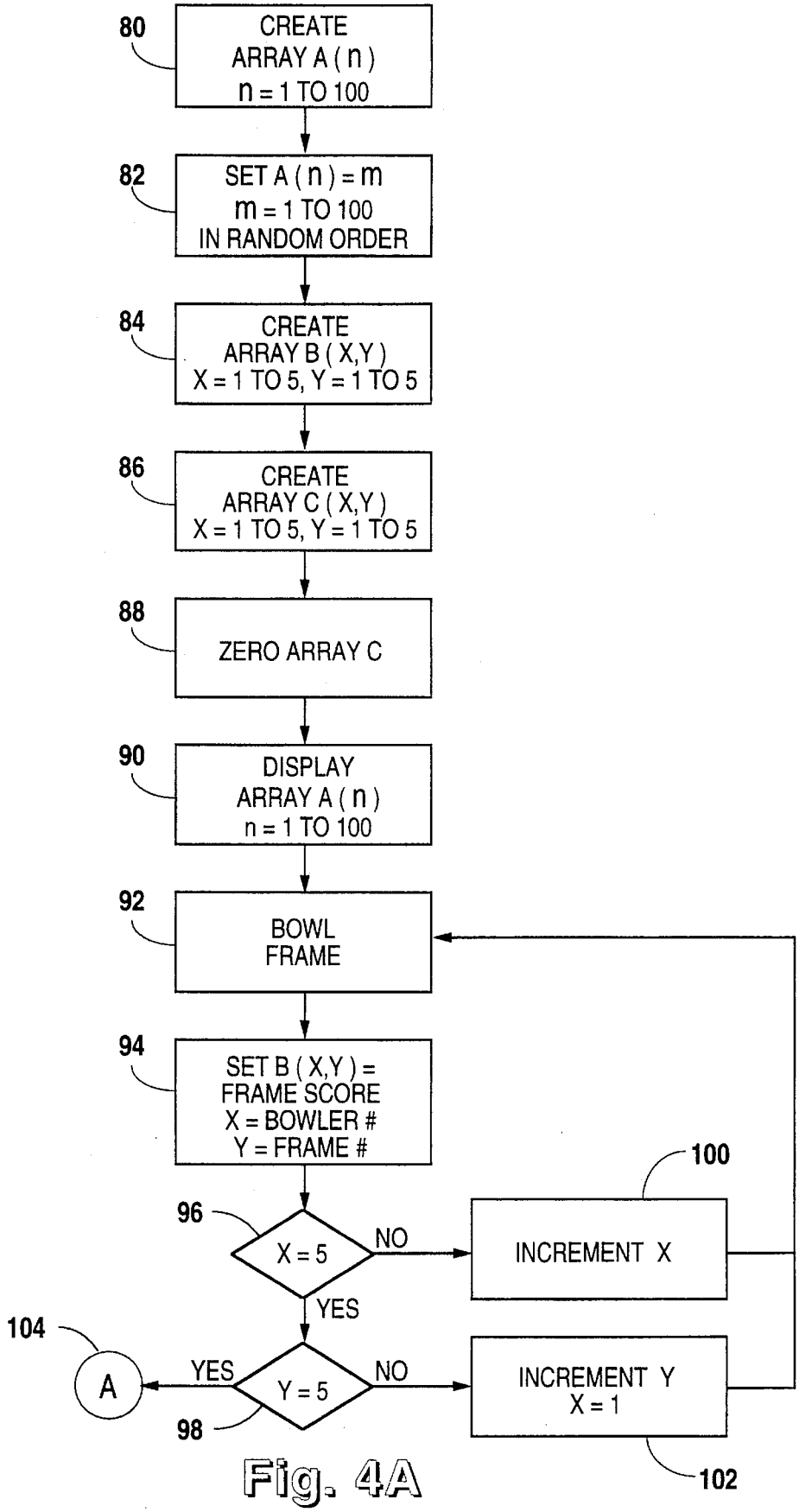
FIG. 4A discloses a flow chart of a typical method of implementing the game rules of the present invention in an automatic scoring system.
Figure 4B:
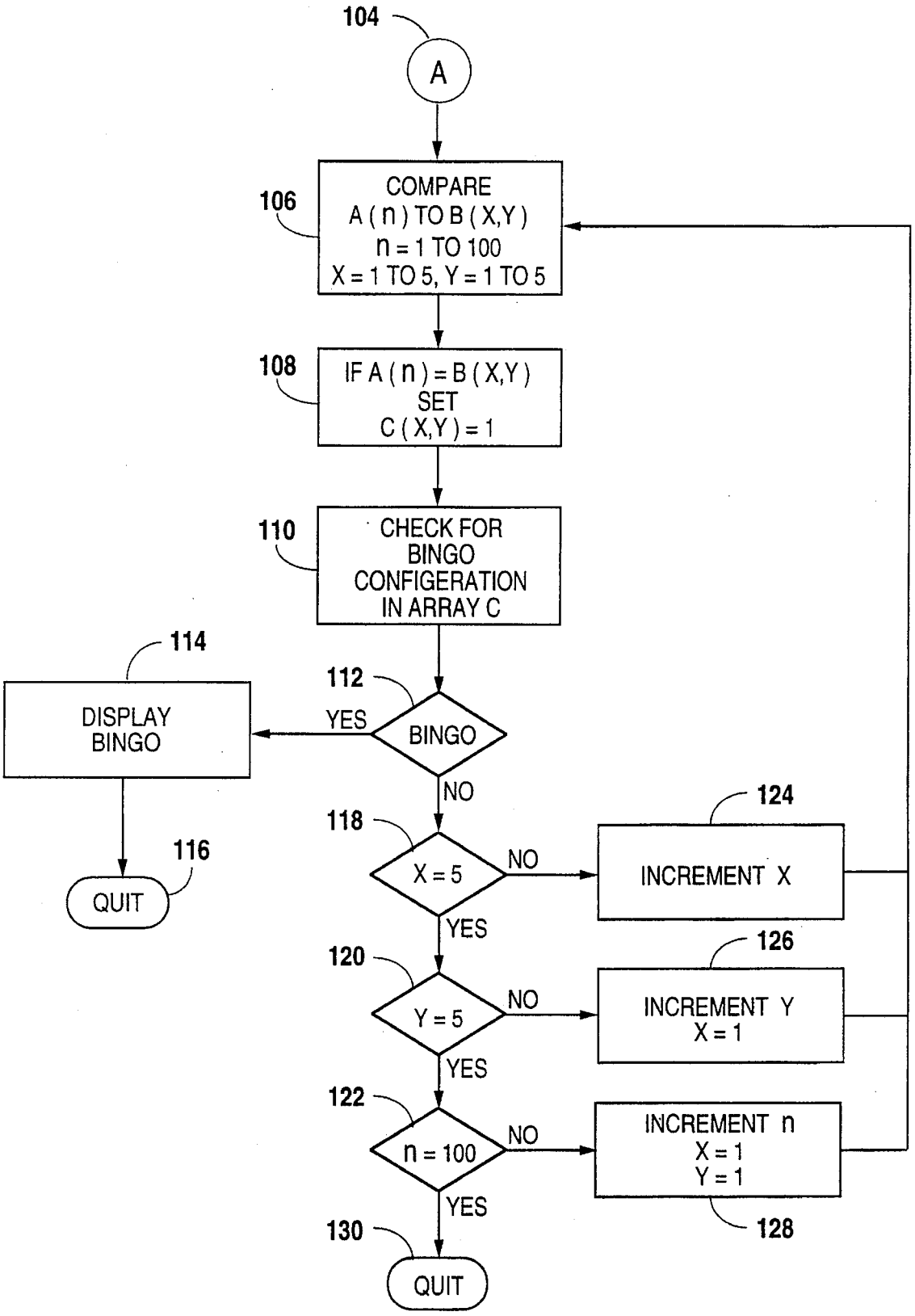
FIG. 4B discloses a continuation of the flow chart disclosed in FIG. 4A.

Reference is now made to FIGS. 4A and 4B for a description of the typical implementation of an automatic scoring system utilizing the game method of play of the present invention. In FIG. 4A, the first step (80) involves the creation of array "A", a single dimensional array with 100 elements. Step (82) involves setting each element in array "A" equal to some number from 1–100 in random order. In step (84), array "B", which in the preferred embodiment is a two-dimensional array, 5 by 5 in dimensions, is created. Step (86) involves the creation of array "C", which is a mirror image of array "B", being two-dimensional and 5 by 5 in the preferred embodiment. Step (88) involves zeroing out array "C" in preparation for use of array "C" as an indication of matching scores and numbers.

Array "A" is displayed, step (90) in some manner such that the bowling participants are aware of the numbers and the order in which they will be called. Step (92) involves the bowling of a specific flame by a particular bowling participant. Step (94) includes storing the frame score achieved in step (92) in array "B", at B(x,y), where x is equal to the bowler number and y is equal to the frame number. Decision step (96) asks the question if all five bowlers (in the preferred embodiment) have bowled for a particular frame, if so, decision step (98) asks if all five frames have been bowled.

If all five bowlers have not bowled a particular frame, then from decision step (96), the bowler number is incremented in step (100) and step (92) is repeated for the next bowler. If in decision step (96) all five bowlers in the preferred embodiment have bowled a particular frame, and in decision step (98) it is not the fifth frame, then in step (102) the frame number is incremented and the bowler number is reset to 1. Step (92) for bowling the next frame is thus repeated. After all five bowlers have bowled all five frames, decision step (98) continues to connection step (104).

FIG. 4A thus shows the accumulation of frame scores in array "B" through a series of bowlers and a series of a preset number of frames. Once again, in the preferred embodiment, this combination involves five bowlers bowling for five frames to create a 5 by 5 "bingo card" for use in the second half of the game. All along, bowlers as they proceed through step (92) by bowling each frame, have the array "A" displayed in from of them such that they might, to some extent, control the scores that they achieve.

Reference is now made to FIG. 4B for the second half of the game wherein the scores accumulated in array "B" are compared with the randomly ordered numbers in array "A". In step (106), array "A" is compared to array "B" by stepping through array "A" incrementally according to the order that the numbers are positioned in the array and additionally stepping through array "B" through the entire two-dimensional array. If any score in an element in array "B" is equal to the number stepped through in array "A", then the corresponding element in array "C" is set equal to 1. This, in step (108), is a mechanism for marking a particular position within array "C" that designates a match. As elements in array "C" are marked to indicate matches, step (110) involves checking for patterns in these arrangements in array "C " as described in more detail above, that qualify for bingo configurations. Decision step (112) determines if a bingo has occurred. If so, step (114) involves displaying the bingo on a monitor or other method for signaling the participants that such has occurred. Once a bingo has occurred, step (116) quits the automatic scoring program. If no bingo occurs from decision step (112), decision step (118) determines if all five bowlers' scores have been stepped through in the process of comparing a particular number from array "A" with scores from array "B". If all five bowlers' frame scores have been checked, decision step (120) then determines if all five frames have been stepped through. If so, decision step (122) determines if all 100 elements in array "A" have been stepped through to compare to the scores in array "B" If so, the program is terminated at step (130).

Back at decision step (118), if all five bowlers' scores have not been checked, step (124) involves incrementing the bowler number and proceeding in array "B" to the next score. Comparison in step (106) and the identification of a match in steps (108) and (110) progress as described above. In decision step (120), if all five frames have not been stepped through for a particular element number in array "A", then in step (126) the frame number is incremented, the bowler number is reset to 1 and, once again, a comparison is made with a particular element in array "A" as in step (106). If all five frames for all five bowlers have been compared with a particular element in array "A", but all elements in array "A" have not been checked, then from decision step (122), in step (128), the count in array "A" is incremented, the bowler number is reset to 1, the frame number is reset to 1 and a new bingo call number is compared from array "A" to each of the scores in array "B". In this manner, all of the scores in array "B" are compared incrementally to each of the numbers in sequence from array "A". As the numbers are compared, matches are identified and tagged by setting a particular element in array "C" equal to 1. Bingo configurations are continuously checked in array "C" as the comparison is being made.

As described above, the present invention lends itself to the combination of bowling rules with a variety of rules associated with games of chance. It can be seen that in many respects, lottery games of chance and bingo games of chance are related in their structure. A lottery pick, for example, may be seen as nothing more than a single bowler bowling a sequence of five or six flames, trying to match a selected set of numbers. In the case of a lottery-type play of the game of the present invention, however, a variety of rules might apply. In a first version of the preferred embodiment, a bowler would complete a typical bowling game, bowling all ten rounds through to completion and then utilize the scores from each of the frames as picks to be compared against a selected set of six randomly generated numbers. In a second version of the preferred embodiment of a lottery-type game of the present invention, the configuration of bowling scores shown in FIG. 1 might be utilized and compared against a similar set of six randomly generated numbers. The first team that acquires all six of these randomly generated numbers at some point in the scores for their bowling would be declared the winner. This is somewhat distinct from the above-described bingo bowling method since a winner may potentially be declared prior to the completion of all five flames by all five bowlers.

In addition, the game methods of the present invention lend themselves to various forms of tournament play within bowling alleys and between bowling alleys in different locations. Further, it can be seen that there is no requirement that competing teams bowl at the same time against each other. Many levels of tournament play are possible, where qualifying rounds involve lottery-type games of the present invention and higher level tournament rounds involve the more complete 5 by 5 bingo version of the game of the present invention.

Although a score card showing a 5 by 5 bingo version of the game has been described, primarily because it is this configuration that is most common in standard bingo play, any of a variety of bingo score card configurations can be utilized. In many cases where it is difficult to arrange for a group of five bowlers to bowl as a team for the purposes of a 5 by 5 bingo score card, individual bowlers might attempt to acquire bingos by simply scoring five in a row in any set of five consecutive frames during a five, seven, or even ten frame game. Thus, a bingo, or five in a row, could be scored by an individual player without support from either subsequent games bowled by that bowler or separate games bowled by team members.

In any case, it can be seen that a variety of different games can be played utilizing the basic precepts of the rules of the present invention. The incorporation of bumper bowling rules as described in applicant's co-pending applications referenced above and incorporated by reference here, permit individual frame scores to be of a greater variety thus, facilitating the acquisition of numbers for use in the bowling bingo or the bowling lottery-type game. That is, where a bowler might normally be limited to modifying his score in a particular frame by only 1–9 pin counts, the bumper bowling systems described by applicant's previous applications permit individual frames to acquire scores over a significantly greater range. A bowler, for example, who holds a 32 score in a particular frame may only accomplish scores in the next frame that would range from 33 to 42 or the like. With the bumper bowling systems described, multiples of the pin count, or numbers added to the pin count, as a result of contact with specific bumpers in the bowling lane system, would permit the bowler to increase the range of potential scores two or three-fold. In this way, the bumper bowling systems and methods of applicant's co-pending applications provide more access to the higher numbers that may have been randomly generated early on in the ordering of array "A".

Clearly an additional modification of the present invention that in many respects nearly eliminates the skill element involved would be to withhold displaying array "A" until the completion of the bowling sequence of frames. In this manner, no participant would be aware of the numbers that would be called in the final steps of the game so no effort could be made to specifically bowl a particular score other than to perhaps bowl as many different scores as possible in a sequence of flames.

A modification of the above rule in which array "A" is not displayed to the bowlers could involve a partial display of the array. After randomly ordering the numbers in array "A", some portion of the numbers could be withheld from display so that mixed elements of skill and chance remain in the game. Alternating numbers could be blacked out so that game participants know some of the numbers that would be called in the order in which they would be called, and would not know the remaining numbers. Other groups of numbers in blocks of five or more (for example) could be withheld to vary the chance elements within the game. Variations of the rules along these lines could be dependent upon the skill level of the particular game participants. The greater the disparity in skill between game participants, the more advantageous it would be to withhold displaying some or all of the numbers and the order in which they appear in array"A".

Other variations of the rules described above are anticipated by the disclosure of the present invention. The claims that follow are intended to cover these and other variations of the game. The fundamental rules of the game involve utilizing the scores acquired on a frame-by-frame basis, according to standard bowling rules or bumper bowling rules, and comparing those scores with randomly generated numbers for the purpose of matching each of a selected set of numbers or for the purpose of matching and creating patterns in the matched sets of numbers.

I claim:

1. A game method of play comprising the steps of:

randomly arranging a group of different numbers into a call order;

displaying said call ordered arrangement of different numbers to all participants in said game;

selecting a number of participants to bowl together as a team and an order in which said participants are to bowl on said team;

selecting a number of bowling frames to be bowled by each of said participants on each of said teams, said number of frames equal to said number of participants on said team;

each of said participants in turn bowling a bowling frame and accumulating a score according to standard rules of bowling on a standard bowling scoring grid made up of cumulative frame scores for each of said participants on said team;

repeating said step of each of said participants in turn bowling a bowling frame until said selected number of frames have been bowled by each of said participants on said team;

comparing one at a time, in order of arrangement, each of said call ordered numbers with individual cumulative frame scores in each of said bowling frames for each of said game participants;

matching each of said individual cumulative frame scores with said call ordered numbers, a match occurring when an individual cumulative frame score in a specific frame, for a specific participant, equals a sequentially selected one of said call ordered numbers; and determining when a first one of a pre-identified pattern of matches occurs, said pattern of matches being an orderly grouping of matched frames on said scoring grid;

wherein said first one of a pre-identified pattern of matches constitutes a winning arrangement for a particular game of said game method of play.

2. The game method of claim 1, wherein said selected number of participants to bowl together as a team comprises five participants and said selected number of bowling frames to be bowled by each of said participants is five, and said scoring grid contains 25 scoring locations in a 5 by 5 array.

3. The game method of claim 1, wherein said randomly arranged group of different numbers comprises a randomly arranged set of all of the numbers from 1 to 100, inclusive.

4. The game method of claim 1, further comprising:

after said step of randomly arranging a group of different numbers, selecting a subset of said randomly arranged different numbers, said subset of said randomly arranged different numbers being displayed to participants in said game; and said step of determining when a first one of a pre-identified pattern of matches occurs further comprises matching each of said numbers in said subset.

5. The game method of claim 1, further comprising the step of providing a modified bowling lane bumper, said bumper having a means for identifying contact with it by a ball, and wherein said step of each said participants in turn bowling a bowling frame and accumulating a score according to said standard rules of bowling is modified by the steps of accumulating a score according to a combination of bowling pins knocked down and a variable numerical characteristic, said variable numerical characteristic determined by contact with said bumper, wherein said means for identifying contact assigns said variable numerical characteristic for modifying said number of bowling pins knocked down for the purposes of determining said score in each of said bowling frames.

* * * * *